US007674982B2

(12) United States Patent
Cloutier et al.

(10) Patent No.: US 7,674,982 B2
(45) Date of Patent: Mar. 9, 2010

(54) ELECTRIC CABLE AND INSULATOR SELF-LOCKING SYSTEM, AND METHOD OF INSTALLATION THEREOF

(75) Inventors: Francois Cloutier, Trois-Rivieres (CA); Paul Gentes, Trois-Rivieres (CA)

(73) Assignee: BMC Innovation Inc., Becancour, Quebec (CA)

( * ) Notice: Subject to any disclaimer, the term of this patent is extended or adjusted under 35 U.S.C. 154(b) by 0 days.

(21) Appl. No.: 12/021,835

(22) Filed: Jan. 29, 2008

(65) Prior Publication Data

US 2009/0188698 A1 Jul. 30, 2009

(51) Int. Cl.
*H01B 17/22* (2006.01)

(52) U.S. Cl. ..... 174/168; 174/169; 174/171; 174/138 F; 174/40 R; 174/170; 248/74.4; 24/525

(58) Field of Classification Search ..... 174/168, 174/169, 171, 172, 138 F, 186, 191, 137 R, 174/40 R, 170, 146, 174, 210; 248/74.4; 24/525

See application file for complete search history.

(56) References Cited

U.S. PATENT DOCUMENTS

| | | | |
|---|---|---|---|
| 3,674,916 | A | 7/1972 | Langella |
| 4,258,228 | A | 3/1981 | Jean et al. |
| 4,741,097 | A | 5/1988 | D'Agati |
| 4,810,837 | A | 3/1989 | Giroux |

FOREIGN PATENT DOCUMENTS

| | | |
|---|---|---|
| CA | 549137 | 11/1957 |
| CA | 488063 | 6/1988 |
| EP | 0 040 384 | 5/1981 |
| EP | 0 051 276 | 10/1981 |
| EP | 0 071 952 | 8/1982 |
| EP | 0 090 881 | 10/1986 |
| EP | 0 326 848 B1 | 1/1989 |
| SU | 737993 A1 | 5/1980 |
| WO | PCT/CA90/00257 | 3/1991 |

*Primary Examiner*—Dhiru R Patel
(74) *Attorney, Agent, or Firm*—Fraser Clemens Martin & Miller LLC; Donald R. Fraser

(57) ABSTRACT

The insulator, includes a lower bell shaped portion, an intermediate annular waist portion and an upper saddle portion for receiving and supporting an electric transmission overhead cable. An axial blind bore opens at its lower end for receiving an upstanding support pin. The saddle portion includes a transversely-curved groove, substantially normal to the axial bore, and jutting parts on each side of the cable receiving groove and laterally protruding from the waist portion. Each jutting part has an external face which is provide with a partly annular groove, generally coaxial with the bore and of greater radius than that of the waist portion. These annular grooves are adapted to positively retain the inturned flanges of a cable retaining clasp despite an upward force or a laterally upwardly directed force exerted by the cable on the clasp. The waist portion can still be used for attaching the electric wire by a tie-wire. The clasp includes male/female joints at each of its two downwardly curved arms that automatically interlock with each other when a sufficient biasing force is applied thereon by a pneumatic tool deforming the clasp arms, drawing the registering flanges of the latter toward one another to lock the insulator to the overhead electric cable.

17 Claims, 18 Drawing Sheets

ELECTRIC CABLE AND INSULATOR SELF-LOCKING SYSTEM, AND METHOD OF INSTALLATION THEREOF

FIELD OF THE INVENTION

The present invention relates to a self-locking connector and biasing tool system for the releasable quick connection to a rigid insulator of an airborne suspended electrical cable forming part of an airborne suspended electrical cable distribution network.

BACKGROUND OF THE INVENTION

Overhead electric cables are usually carried by porcelain insulator which are maintained upright by an upstanding pin engaging an axial blind bore of the insulator body, the pin fixed to the cross-arm of a ground pole or tower. The insulator has a saddle like upper portion which receives and supports the electrical cable. The latter is attached to the insulator by the difficult operation of manually winding and twisting a small diameter tie wire around the electrical transmission cable and a waist portion at the base of the insulator saddle portion.

In international patent application publication NO WO 91/03061 dated 7 Mar. 1991 for an "insulator for overhead electric wires", there is disclosed a clasp which facilitates attachment of an electrical conductor cable to the insulator.

This clasp includes a metallic clamp and an elastomeric wire gripping element carried inside the clamp for surrounding and being pressed against the wire for firmly retaining the latter against longitudinal slipping. The clamp itself is a metal piece forming a central top web, with a pair of lateral downwardly extending opposite arms, in turn provided with inturned lower flanges, each having an inner partly circular recess. The clamp arms flanges remain spaced from one another at all times.

Conventional insulators have a lower bell-shaped portion and a saddle portion. The saddle portion includes a transverse electric wire-receiving groove and jutting parts on each side of the groove. The external surface of each jutting part includes a side face portion, which is downwardly inwardly inclined and which smoothly merges with the top of the bell-shaped portion at a narrowest waist area between the top saddle portion and the lower bell-shaped portion. In their operative condition, the above-noted prior art clasp arm flanges engage frictionally beneath the two corresponding insulator jutting parts, slightly above said narrowest waist area of the insulator, and on opposite sides of the insulator. The clasp arm flanges do not engage with one another.

When using the above-noted prior art clasp on an insulator, it was found that the clamp could accidentally detach from the insulator under certain load-induced circumstances.

There may therefore still be a problem of reliability in the electrical cable interconnection between the clamp and the insulator.

SUMMARY OF THE INVENTION

In accordance with the teachings of the invention, there is disclosed a self-locking system for locking a section of suspended electrical conductor cable to a pin type insulator, the insulator having an upper arcuate saddle part defining a groove, for receiving therein the cable, and two opposite jutting parts, a main peripheral skirt body having an intermediate annular recess, and a lower end for engagement by an upright pin, said self-locking system comprising: an arcuate clasp defining a resilient web, first and second side arms integrally projecting from opposite ends of said web, each of said first and second side arms defining corresponding first free edge and second free edge opposite said web, said first free edge being in spaced register with said second free edge and defining therebetween a gap in the unbiased condition of said resilient web whereby a generally open pocket is circumscribed by said web and said side arms and for receiving therein the electrical conductor cable; said gap sized to accommodate free transverse passage of the electrical conductor cable; each of said side arm defining a recess sized for transverse through passage by a corresponding one of the jutting parts of the insulator saddle; a first male/female joint means carried at said first free edge, a second male/female joint means carried at said second free edge, wherein said first joint means and said second joint means form when assembled a complementary male/female interlocking joint assembly; and biasing means, for biasing said clasp against the resiliency of said web to close said gap and to concurrently engage said first joint means and said second joint means into said interlocking joint assembly, said side arms sized to retainingly fit into the intermediate annular recess of the insulator beneath the jutting parts thereof when said first joint means and said second joint means become interlocked.

An elastomeric sheath member, may be provided, integrally carried by said web within said clasp pocket, said sheath member being arcuate in unbiased condition defining an enclosure with an access mouth sized for enabling access by the conductor cable to said sheath member enclosure. The clasp first and second side arms may also be made from a resilient material, as with the clasp web.

The sheath member enclosure access mouth may come in register with said clasp side arms gap; or alternately, could be offset relative to said clasp side arms gap.

Preferably, said first male/female joint means is a first flange means integral to said first side arm free edge, said first flange means defining a first lip means and a first trough means; and wherein said second male/female joint means is a second flange means integral to said second side arm free edge, said second flange means defining a second lip means and a second trough means, either said first lip means could engage said second trough means when said first and second male/female joint means are in their interlocked assembled state, or said second lip means could engage said first trough means when said first and second male/female joint means reach their interlocked assembled state.

Preferably, in the unbiased condition of said clasp, said clasp web is elbowed and said clasp first side arm is symmetrically offset from said clasp second side arm relative to said web, so that an enlarged cable passageway be defined between said clasp first side arm and said sheath member.

Said biasing means could include a rigid arcuate compression member, complementary in shape with said clasp so as to define a generally open cavity for accommodating therein said clasp, said compression member having opposite clasp retaining ears for frictionally releasably engaging said clasp side arms inside said open cavity, and compressive fingers projecting transversely from an intermediate section of said compression member for engaging said resilient clasp web on the outside face of said web relative to said compression member cavity; hydraulic ram means, for releasably biasing said compression member to deform said clasp side arms whereby said clasp side arms progressively move toward one another to close said gap; and a pivotal lever arm assembly, cooperating with said hydraulic ram means for supporting the insulator and conductor cable relative to said clasp.

An elongated pole member could then be added, as well as means for mounting said pole member to said pivotal lever arm assembly for controlled relative movement thereabout, wherein said self-locking system is remote-controlled.

Said pivotal lever arm assembly could then include: a main rigid frame; an elongated arcuate first lever arm; a first pivot mount, pivotally interconnecting an intermediate section of said compression member to said first lever arm; a hydraulic ram including a cylinder and a piston, said piston having an outer free end, and hydraulic fluid feed means coupled to said cylinder; a second pivot mount, pivotally interconnecting said cylinder to said main rigid frame; a third pivot mount, pivotally interconnecting said piston outer free end to an inner end of said first lever arm; first and second insertion legs, for engagement therebetween of the conductor cable, and a diverging bracket interconnecting said first and second insertion legs, said first leg having an outer end;

a fourth pivot mount, pivotally interconnecting arm outer end of said first lever arm opposite said inner end thereof to said first insertion leg outer end; and an inclined ramp made on said main rigid frame, said ramp slidingly engaged by said insertion leg bracket; wherein said insertion arm bracket progressively upwardly sliding along said ramp upon said piston being retracted from said cylinder, while said compression member concurrently biases said clasp side arms to close said gap.

The invention also relates to a self-locking system for locking a section of suspended electrical conductor cable to a pin type insulator, the insulator having an upper arcuate saddle part defining a groove for receiving therein the cable and two opposite jutting parts, a main peripheral skirt body having an intermediate annular recess, and a lower end for engagement by an upright pin, said locking system comprising: resilient clamping means having a inner pocket, for receiving therein the electrical conductor cable, retaining means for retainingly engaging the insulator jutting parts, and an access port for transverse passage of the cable into said pocket, said access port being opened in the unbiased condition of said resilient clamping means; a quick coupling joint means, cooperating with said clamping means for releasably maintaining in closed condition said access port against the resiliency of said clamping means; and biasing means, biasing said clamping means against the resiliency of said clamping means to close said gap and to enable concurrent engagement of said quick coupling joint means.

A clicking sound cue could occur after engagement of said first lip means into said second trough means confirming said interlocking assembled state has been reached.

The invention also relates to a method of installation of an electrical conductor cable onto a pin-type insulator, the insulator having an upper arcuate saddle part, defining a groove for receiving therein the cable, and two opposite jutting parts, a main peripheral skirt body having an intermediate annular recess, and a lower end for engagement by an upright pin, said method of installation comprising the following steps: a) providing an arcuate clasp, said clasp defining a resilient web, first and second side arms integrally projecting from opposite ends of said web, each of said first and second side arms defining corresponding first free edge and second free edge opposite said web, said first free edge being in spaced register with said second free edge and defining therebetween a gap in the unbiased condition of said resilient web whereby a generally open pocket is circumscribed by said web and said side arms and for receiving therein the electrical conductor cable; said gap sized to accommodate free transverse passage of the electrical conductor cable; each of said side arm defining a recess sized for through passage by a corresponding one of the jutting parts of the insulator saddle; first male/female joint means carried at said first free edge, a second male/female joint means carried at said second free edge, wherein said first joint means and said second joint means form when assembled a complementary male/female interlocking joint assembly; an elastomeric sheath member integrally carried by said web within said clasp pocket, said sheath member being arcuate in unbiased condition defining an enclosure with an access mouth sized for enabling access by the conductor cable into said sheath member enclosure; —b) engaging the conductor cable through said clasp gap and into said clasp inner pocket; c) engaging the conductor cable further through said sheath access mouth and into said sheath member enclosure; and —d) applying a first biasing force onto said clasp against the resiliency of said web whereby said sheath member access mouth becomes closed; and e) applying a further biasing force onto said clasp against the resiliency of said web whereby said clasp gap becomes closed, while concurrently engaging said first joint means and said second joint means in said interlocking joint assembly; wherein said side arms are sized to retainingly fit into the intermediate annular recess of the insulator when said first joint means and said second joint means become interlocked.

Preferably, the above-noted steps a), b), c) and d) are carried out at ground level, and further including the following steps occurring between said step d) and step e): d') mounting the interconnected assembly of insulator, clasp and cable into a pivotal open head of an elongated hand pole, d") tilting said hand pole to lift said insulator, clasp and cable assembly above ground to the top of an electrical cable tower; and d"') remotely actuating the pivotal head for further biasing force action against said clasp.

The self-locking connector and biasing tool for electrical wire insulator of the invention may thus consist of three main components:

- a deformable retaining clamp having self-locking semi-flexible arms;
- a cable-receiving web made from an elastomeric material or from EPCM; and
- a biasing tool for deforming the clamp arms in their locking condition.

In one embodiment, the conception of the retaining clamp will be such that its top will be initially concave and that its arms will be sufficiently spread apart as to enable installation thereof without having to pull the arms away from one another to allow the electrical cable to pass. By applying an appropriate level of biasing force with a biasing tool, for example, a pneumatic tool, against the self-locking arms, the clamp arms will deformingly move toward one another while the self-locking system will concurrently interlock once the edge lips of the clamp arms come to frictionally overlap with and engage each other in spring loaded fashion. An elongated pole may be used by an electrician to first remotely engage the electrical cable into the elastomeric web, and then to remotely apply the closure biasing forces against the clamp self-locking arms so as to interlock the clamp arms.

In an alternate embodiment of the invention, the clasp will be concavo convex, and will be of such construction as to enable partial ground installation of the electric cable therein before the clasp/cable assembly is lifted to the top of the electric utility ground tower, for final completion of installation.

The elastomeric sheath will be sized and shaped to efficiently support the electric cable while enabling retention of the electrical cable in a lengthwise direction, including being able to sustain various tear forces including so-called "galloping" forces.

The insulator consists of a body made from an electrically insulating material, having a top and a bottom end and forming a lower bell-shaped portion, an intermediate, annular, waist portion and a top saddle portion, the body having an axial bore opening at the bottom end thereof for receiving an upright support pin, the top saddle portion having a transversely curved wire receiving groove substantially normal to the axial bore, the top saddle portion forming jutting parts on each side of the electric cable receiving groove and laterally protruding from said waist portion, said jutting parts each having an external face facing away from the cable receiving groove and provided with a partly annular clamp-retaining groove, generally coaxial with said bore, and of a greater radius than the minimum radius of said waist portion, said clamp retaining groove adapted to positively retain the inturned flanges of a clamp having a web for overlying the cable receiving groove and an electrical cable, supported thereon, and downturned arms for embracing the jutting parts with the flanges extending from the lower ends of the clasp arms.

The present self-locking connector and biasing tool system will be effective for all types of ceramic insulator currently in use worldwide, and for most envisioned new plastic type insulators currently being developed. This self-locking system will be particularly well suited to replace the various existing connecting cables, such as tie wires, super ties, and preformed ties. This self-locking system will therefore be safe and easy to use, its self-locking being very reliable compared to existing connectors that are submitted to high wind galloping conditions on air borne suspended wires.

DETAILED DESCRIPTION OF THE PREFERRED EMBODIMENT OF THE INVENTION

Figure 1:
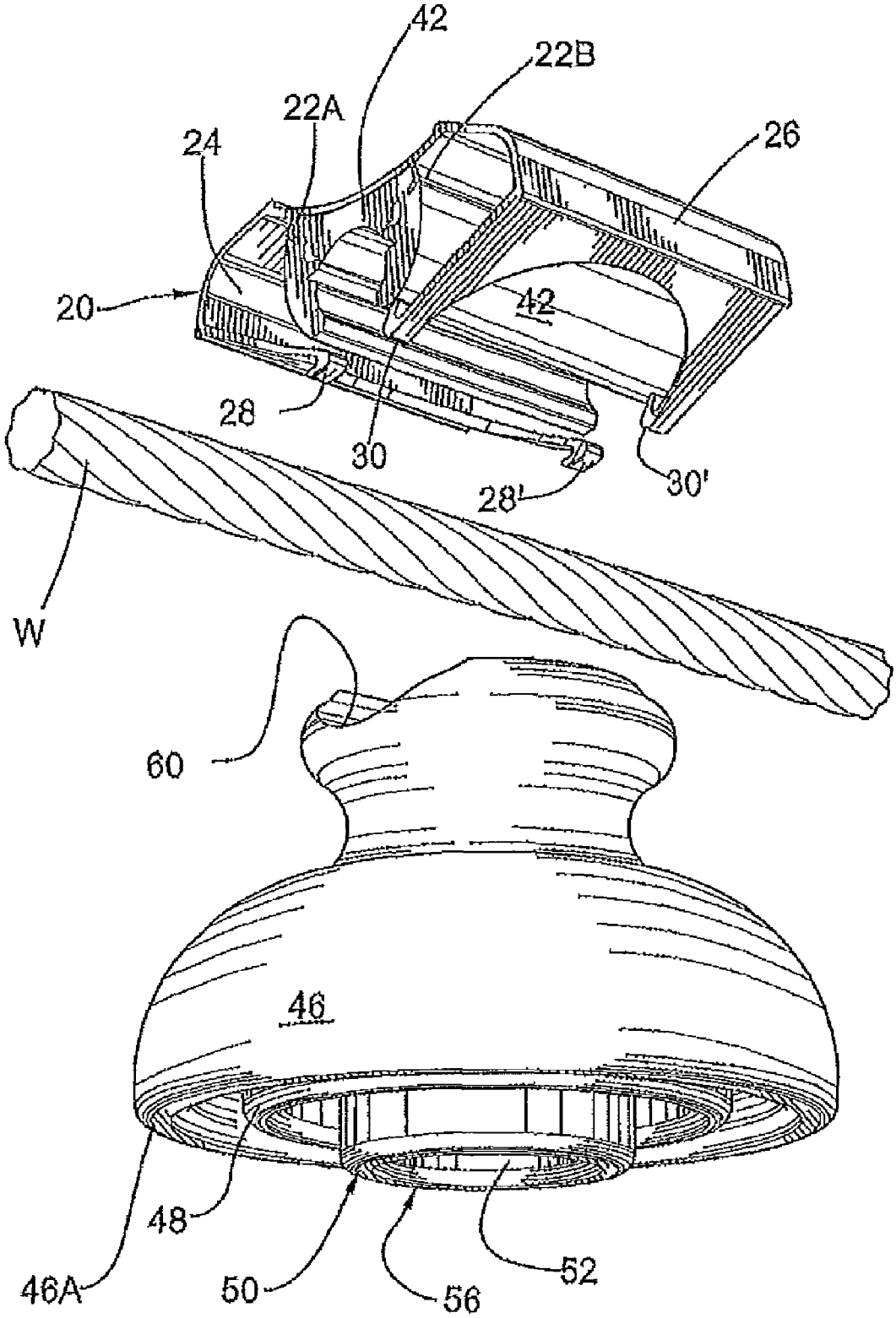
FIG. 1 is an exploded perspective view of a pin type insulator, of a segment of a suspended electric conductor cable and of a first embodiment of clasp attaching the cable to the insulator saddle.

According to a first embodiment of the self-locking connector system illustrated in FIGS. 1-11, there is disclosed a resilient clamping means 320 forming semi-rigid clasp 20 having a main web 22 from which project a retaining means forming a pair of opposite arcuate arms 24, 26. At least clasp main web 22, and preferably also side arms 24, 26, are made from a resilient material so as to be spring loaded wherein side arms 24 and 26 have limited tilt capability relative to one another. Each arm 24, 26, defines a main body with a pair of free end flanges 28, 28', and free end flanges 30, 30', respectively.

In their unbiased condition, the two side arms 24, 26, are spaced apart, and define a spacer gap G between their pairs of proximal end flanges 28, 28', 30, 30', wherein a generally open inner pocket K is circumscribed by web 22 and arms 24 and 26. Flanges 28, 28', are in spaced register with flanges 30, 30', when web 22 is unbiased.

Laterally spaced flanges 28, 28', of arm 24 are outturned, while laterally spaced flanges 30, 30' of arm 26 are inturned relative to clasp inner pocket K. Gap G can be closed when a suitable level of biasing force is applied against the web 22 to bias both arcuate arms 24, 26, wherein the resilient web 22 becomes deformed and bent and the two pair of end flanges 28, 28', 30, 30', move toward one another and come to engage and to overlap against one another, with the lips 28*a* from flanges 28, 28', engaging the trough 30*b* of the other flanges 30, 30', or vice-versa, to automatically frictionally interlock under spring loaded conditions, to form a quick coupling joint means 350.

This biasing force thus acting on arms 24, 26, via resilient web 22, may be borne for example by a pneumatic tool, as illustrated in FIGS. 20-26 and detailed later on hereinbelow.

A section of electric cable W is to be attached to an insulator 40 by clasp 20. Clasp 20 further comprises a semi-flexible sheath 42, or cable gripping component, carried by the clasp 20 inside thereof. Sheath 42 may be elastomeric, e.g. from rubber. The arms 24, 26, including the flat central web portion 22 are preferably made from extrusion of aluminum cut to length and machined. Each arm 24, 26, has a semi-circular recess 28B, 30B, (FIG. 8) respectively at its inner wall portion.

The cable gripping element or sheath 42 includes a body of elastomeric partly conducting material, which is anchored into protruding spaced apart web ears 22A, 22B within the clasp web 22 and is adapted to surround and grip the electrical cable W into an enclosure 44. In this embodiment, sheath enclosure 44 has a mouth 45 (see FIG. 9) opening directly toward gap G.

Figure 12:
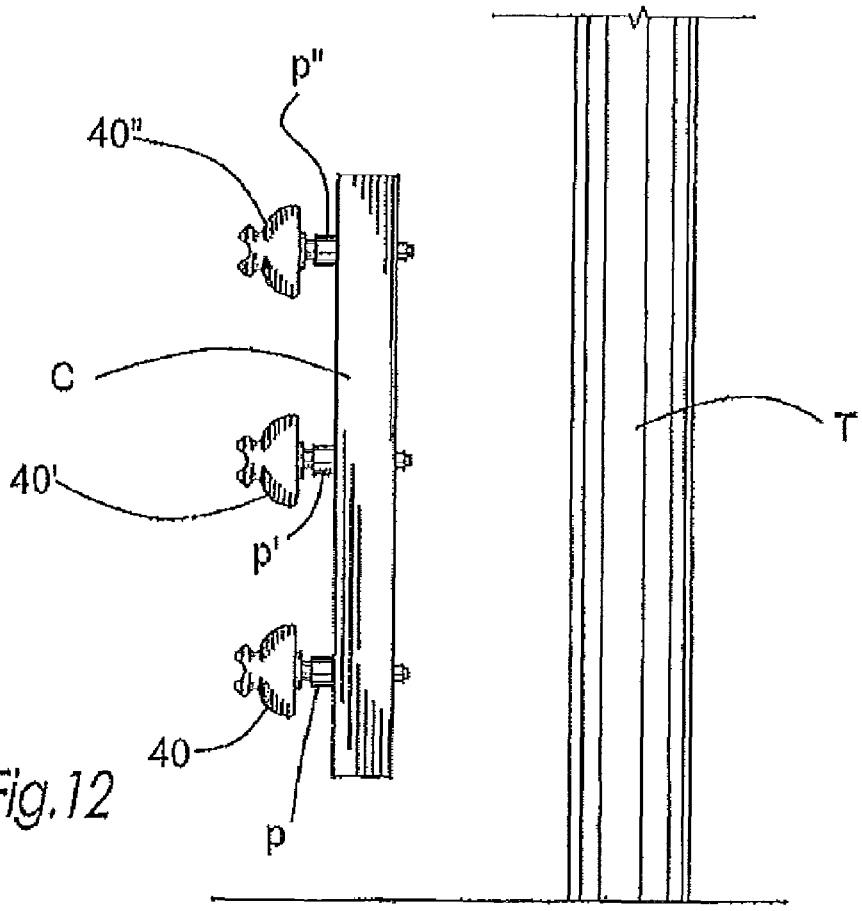
FIG. 12 is a partial elevational view of the lower end of an upright ground tower and of a cross beam holding three spaced insulators mounted at ground level.
Figure 13:
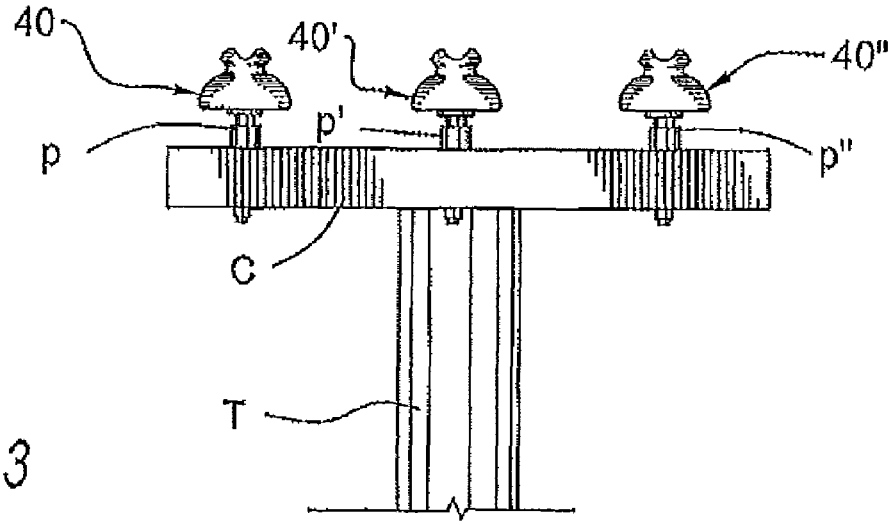
FIG. 13 is a partial elevational view of the upright tower of FIG. 12, but with the cross-beam now installed at the top end thereof.

Insulator 40 is made from an insulating material of high resistivity, such as porcelain. Insulator 40, like any other convention insulator of the same type, is formed with a lower bell-shaped portion 46 forming a skirt surrounding a pair of concentric circular integral inner wall portions 48 and 50. The radially innermost wall 50 extends beyond the plane of the bottom edge 46A of exterior skirt 46, and defines an inner central blind bore 52 having an enlarged lower frusto-conical section 56. Blind bore 52 is coaxial with skirt 46 and walls 48 and 50. As illustrated in FIGS. 12 and 13, threaded support pins P, P', P" are conventionally adapted to be screwed in bore sections 52 to support the insulators 40, 40', 40", respectively in upright position. Pins P, P', P", upstand from the cross-arm C of a ground utility pole or tower, T.

Figure 2:
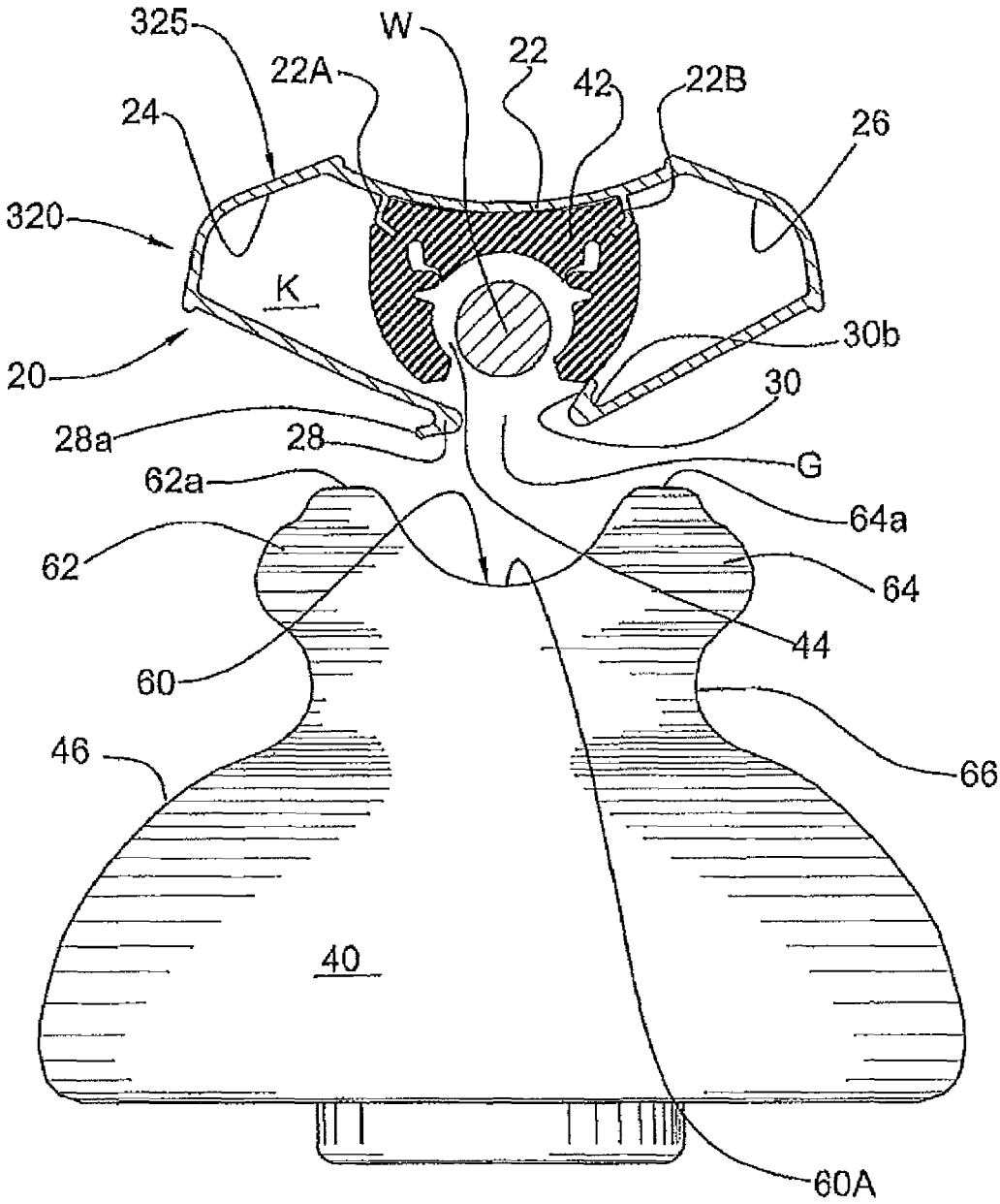
FIG. 2 is a cross-sectional view of the clasp and electrical cable of FIG. 1, with the clasp being engaged by the cable, and also showing in sectional view the pin type insulator closely spaced from the clasp.
Figure 3:
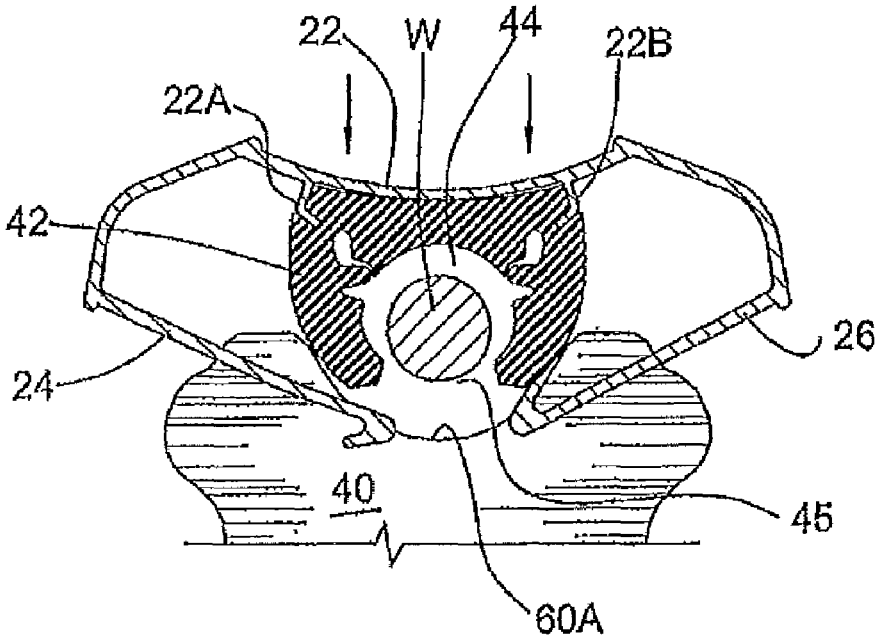
FIGS. 3 to 7 are cross-sectional views of the clasp, electrical cable and insulator of FIG. 1, sequentially suggesting how the self-locking mechanism of the clasp comes into play during progressive interlock of the clasp, cable and insulator.
Figure 4:
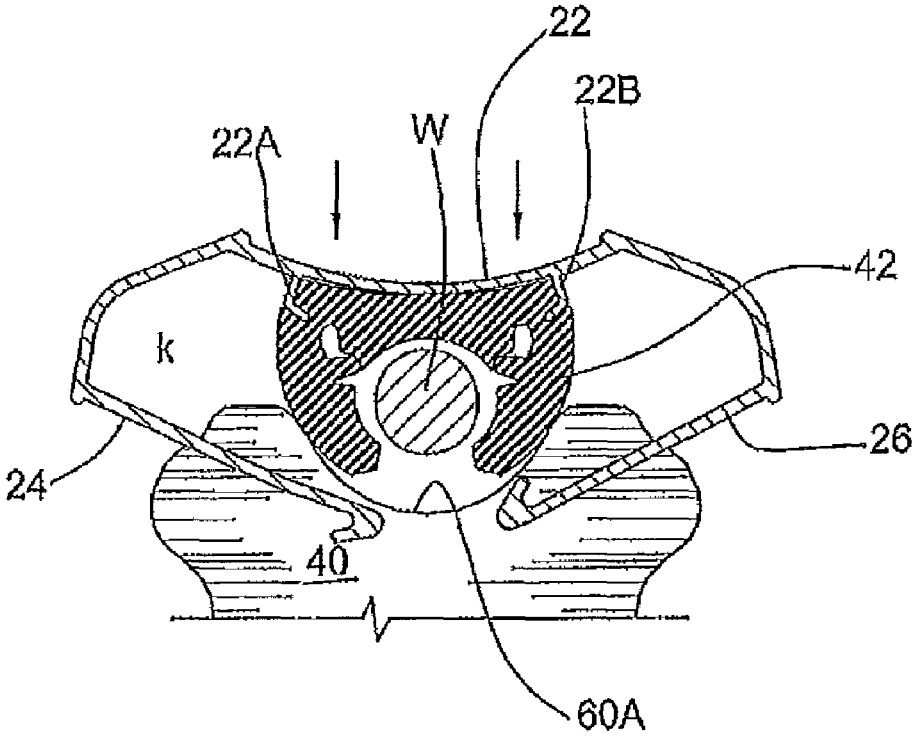
Figure 5:
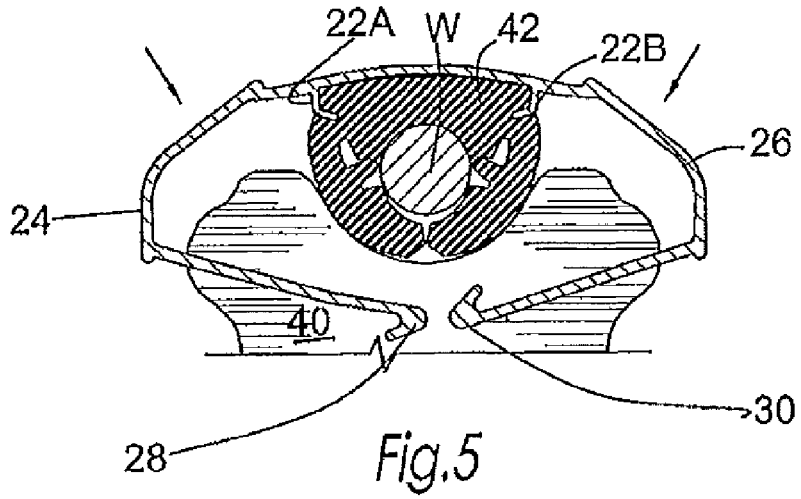
Figure 6:
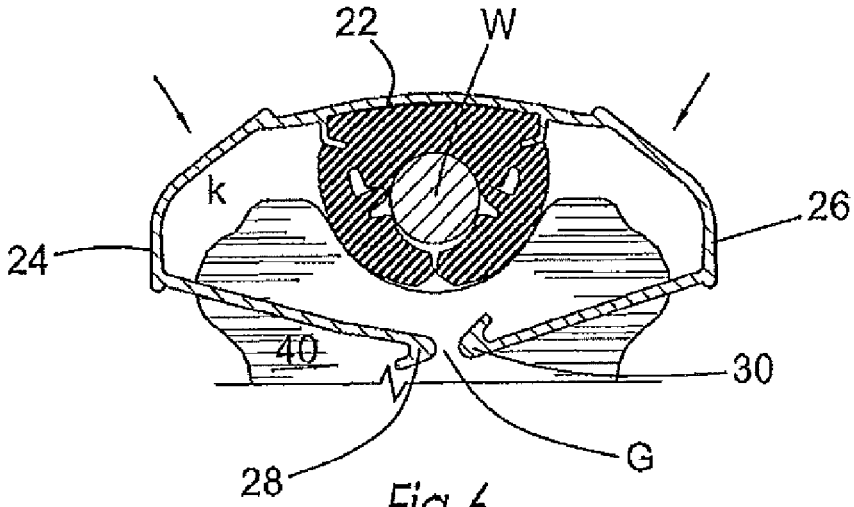
Figure 7:
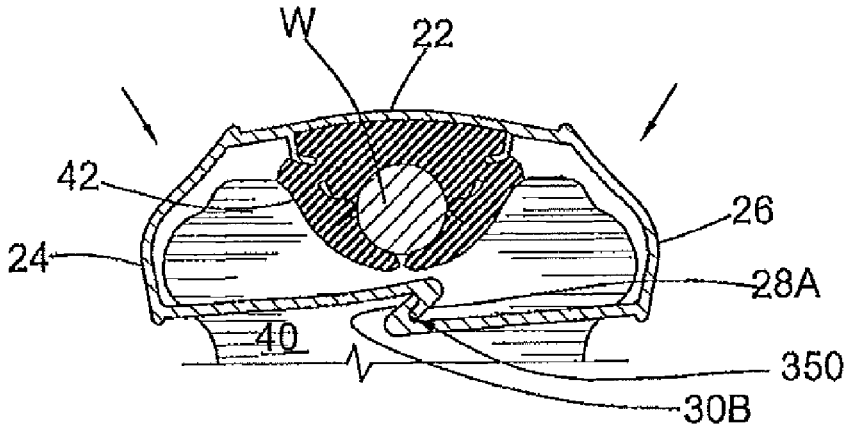

The upper portion of the insulator forms a saddle 60 for receiving and supporting the electric cable W. This saddle 60 includes a central transversely arcuate wire receiving groove 60A, and two diametrically opposite, similar, jutting parts 62, 64. Groove 60A receives the sheath member 42 surrounding the cable W, as shown in FIG. 2. The saddle 60 merges with skirt 46 at the top of the latter through a narrowest annular waist portion 66 forming the junction of the top of skirt 46 with the base of the saddle 60. This saddle 60 is of a width smaller than the widest portion of the skirt 46 but greater than said annular waist portion 66.

For the attachment of the cable W to the insulator 50 by means of the clasp 20, and contrarily to the clasp in the above-noted publication WO 90/03061, the tiltable arms 24, 26, of the clasp 20 need not be spread apart to clear the jutting parts 62, 64, so as to bring flanges 28, 28', 30, 30' around and under the insulator saddle parts 62, 64, for the clasp 20 to be locked to the insulator 40.

Each jutting part 62, 64, has a top face portion 62A, 64A, merging with the groove 60A. The plane of the two top face portions 62A, 64A, is preferably normal to the lengthwise axis of bore 52. Faces 62A, 64A, which have been illustrated as being flat and coplanar, can have other shapes, such as a convex shape.

Figure 8:
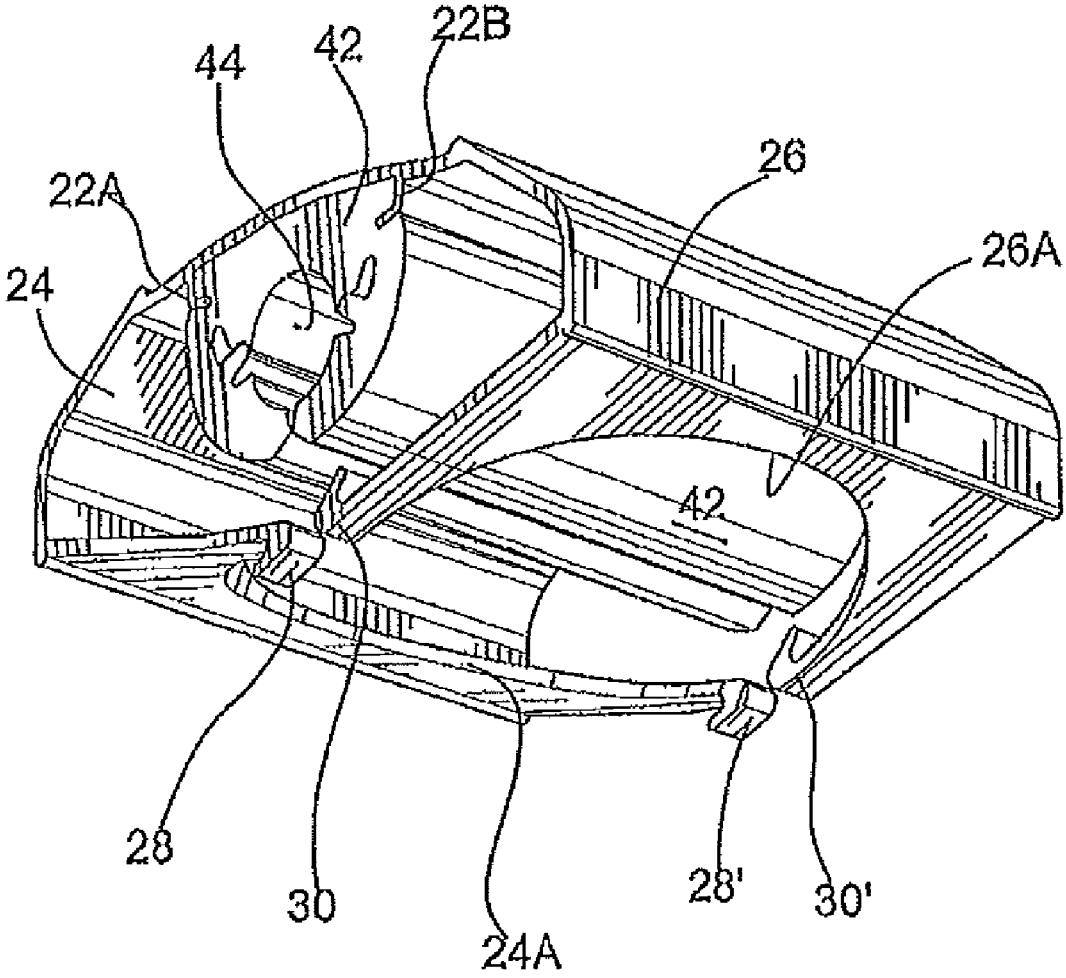
FIG. 8 is an enlarged perspective view of the clasp at the upper portion of FIG. 1.
Figure 9:
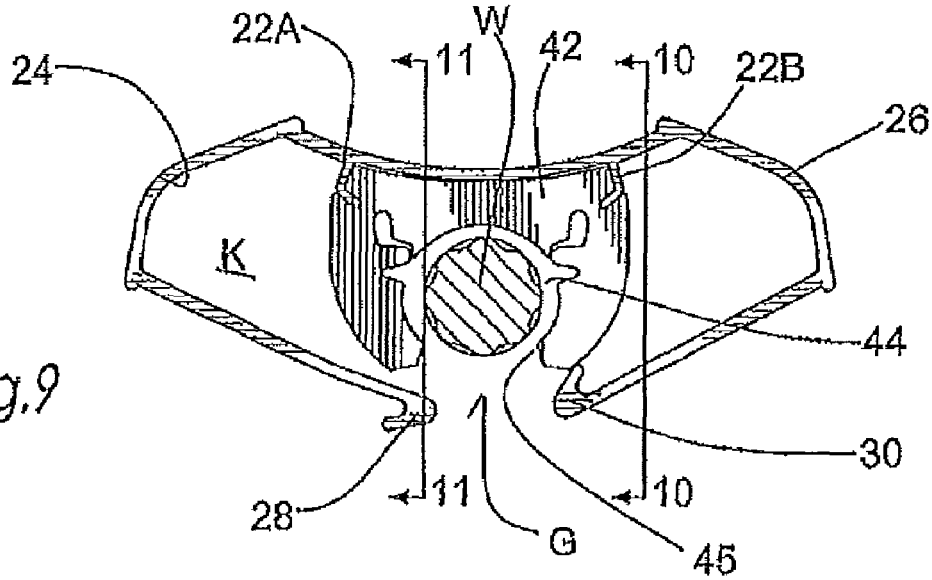
FIG. 9 is another cross-sectional view of the clasp and wire similar to that of the upper portion of FIG. 2.
Figure 10:
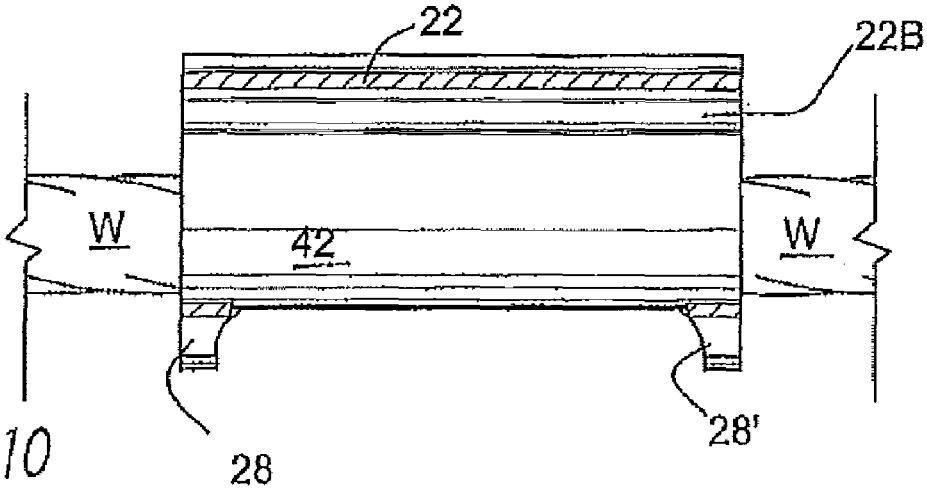
FIG. 10 is a sectional view taken along line 10-10 of FIG. 9.
Figure 11:
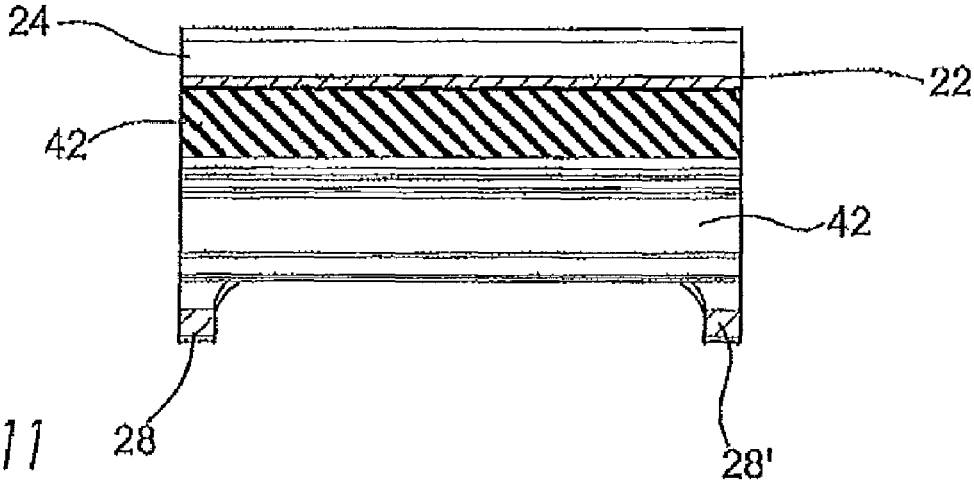
FIG. 11 is a sectional view taken along line 11-11 of FIG. 9.

As illustrated in FIG. 8, a semi-circular recess 26A is formed in arm 26 between laterally spaced apart flanges 30 and 30', and similarly, a semi-circular recess 24A is formed in arm 24 between laterally spaced apart flanges 28 and 28'. Recesses 24A, 26A, open into each other, to form a circular aperture sized to be large enough to fit around and clear the insulator jutting parts 62, 64, so that flanges 28, 28', and 30, 30' may come to eventually fit about insulator narrowest annular section 66 beneath jutting parts 62, 64 (see also FIGS. 19 and 26), whereby the clasp 20 with associated cable W become anchored to the insulator saddle 60, wherein positive gripping action of clasp 20 on both the conductor cable W and its insulator 40 is achieved. Jutting parts 62,64, extend, when seen in top plan view, through a circular arc of about 90 degrees.

Although self-locking means 28, 28', 30, 30', are shown as outlined edgewise flanges 28, 28', of arm 24, and inturned edgewise flanges 30, 30' of arm 26, other types of male/female joint means are envisioned to be within the scope of the present invention: for example, male/female dovetail joint means, or complementary arrow-shape male/female joint means, or the like. Moreover, the self-locking means are not limited to male/female joint means and could extend to various sorts of quick coupling devices, for example turnbuckle type interlock systems, snap shackle couplings, and the like.

Figure 14:
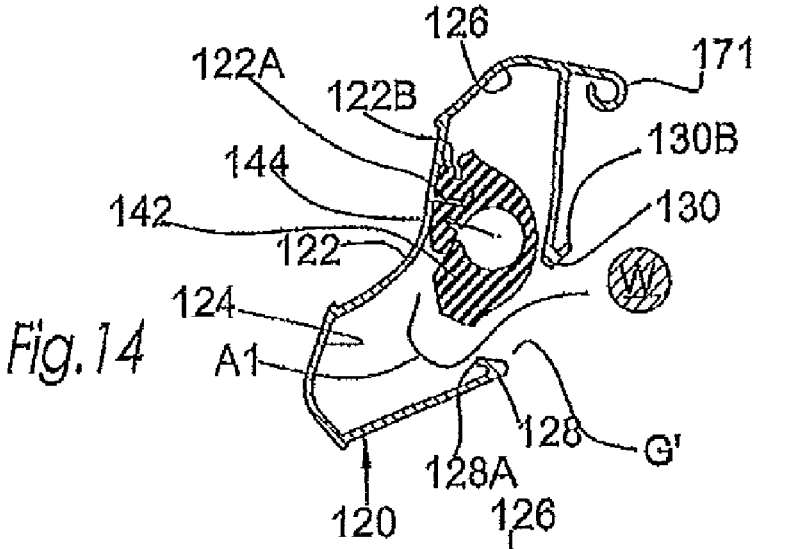
FIGS. 14-16 are sequential assembly cross-sectional views of an electric cable into an alternate embodiment of concavo-convex clasp, in the context of an installation in accordance with the method outlined in FIGS. 12 and 13.
Figure 15:
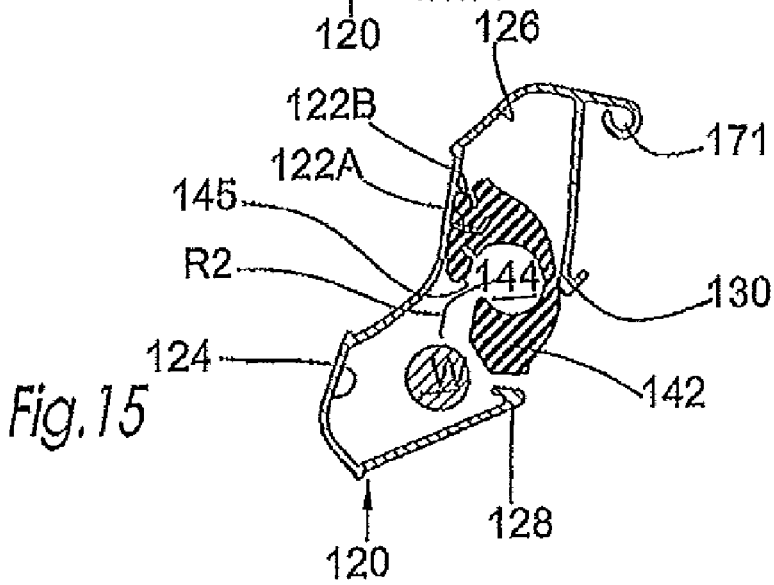

FIGS. 14-19 disclose an alternate embodiment of clasp 120, with similar components thereof being identified under a corresponding 100-series reference numerals. Clasp 120 is different from concave clasp 20 of the first embodiment, first in that its shape is concavo-convex in unbiased state. That is to say, arms 124 and 126 are not symmetrically laterally disposed, but rather, web 122 is partly bent in unbiased state to bring arm 124 in transversely offset condition relative to arm 126. As suggested by the arrow A1 in FIG. 14, this allows cable W to pass freely transversely between arm 124 and elastomeric sheath 142 along a free passageway. Other differences include that mouth 145 of sheath 142 opens in direction opposite gap G' between flanges 128 and 130, and that both web retainer ears 122A, 122B are located on the same side of the arm 126 of clasp 120 so that cable W may engage through mouth 145 into sheath 142 while the sheath 142 substantially closes gap G', as illustrated in FIG. 15, wherein there is no need for cable W to sit on an insulator saddle for cable W to fit into clasp 120.

Arm 126 further includes a transverse arcuate outward extension leg 171, intermediate flange 130 and web 122 and projecting in the same general direction as flange 130. As suggested in FIG. 18, leg 171 is engageable with insulator narrowest section 166 so as to act as an abutment seat for arm 126 when elbowed arm 124 is to be forcibly deformingly mounted against the opposite jutting part 162 of insulator 140. Clasp 120 of FIGS. 14-19 is particularly well suited for ground installation of the cable W to a cross-beam C, as illustrated in FIGS. 12 and 13, before the cross-beam C is fitted at the top of the ground tower T.

Figure 16:
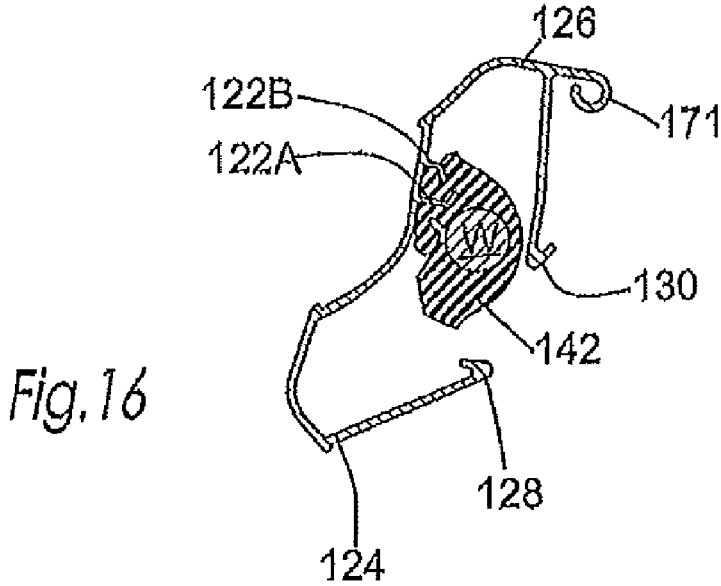
Figure 17:
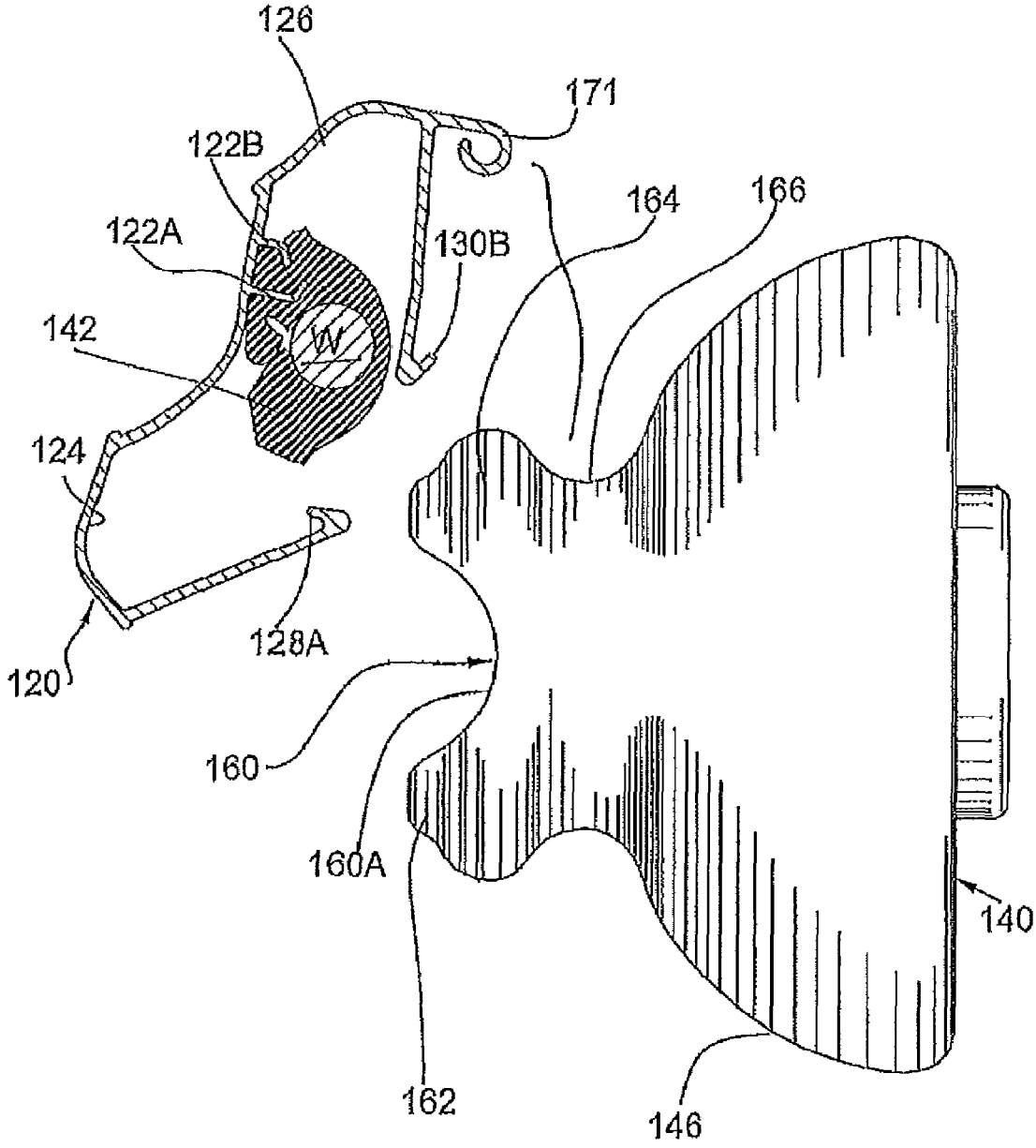
FIGS. 17-19 are sequential assembly cross-sectional views of the interconnected clasp and cable of FIG. 16, and of a pin type insulator, suggesting how the self-locking mechanism of the clamp comes into play during progressive interlock of the clasp and cable assembly and insulator.
Figure 18:
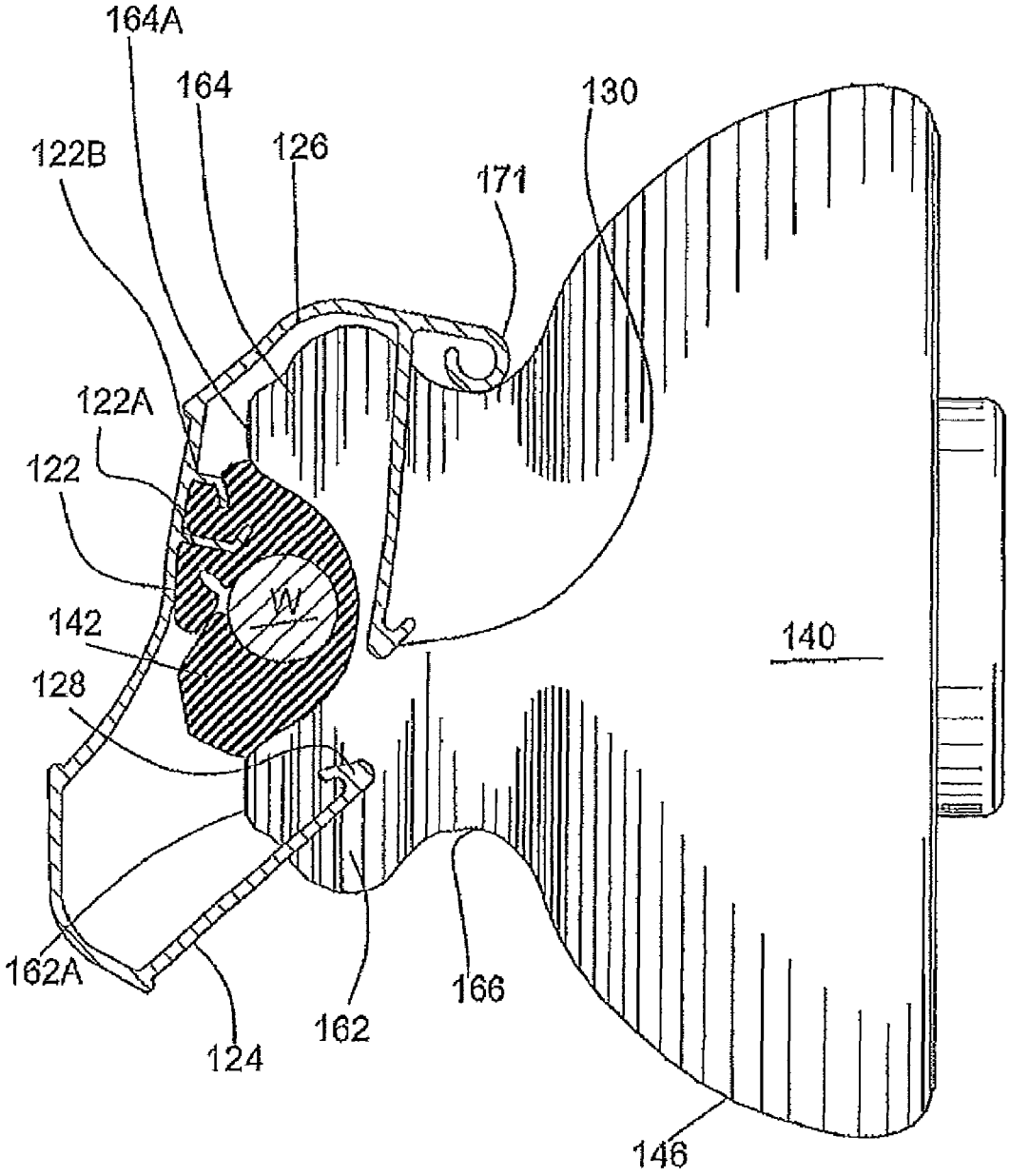
Figure 19:
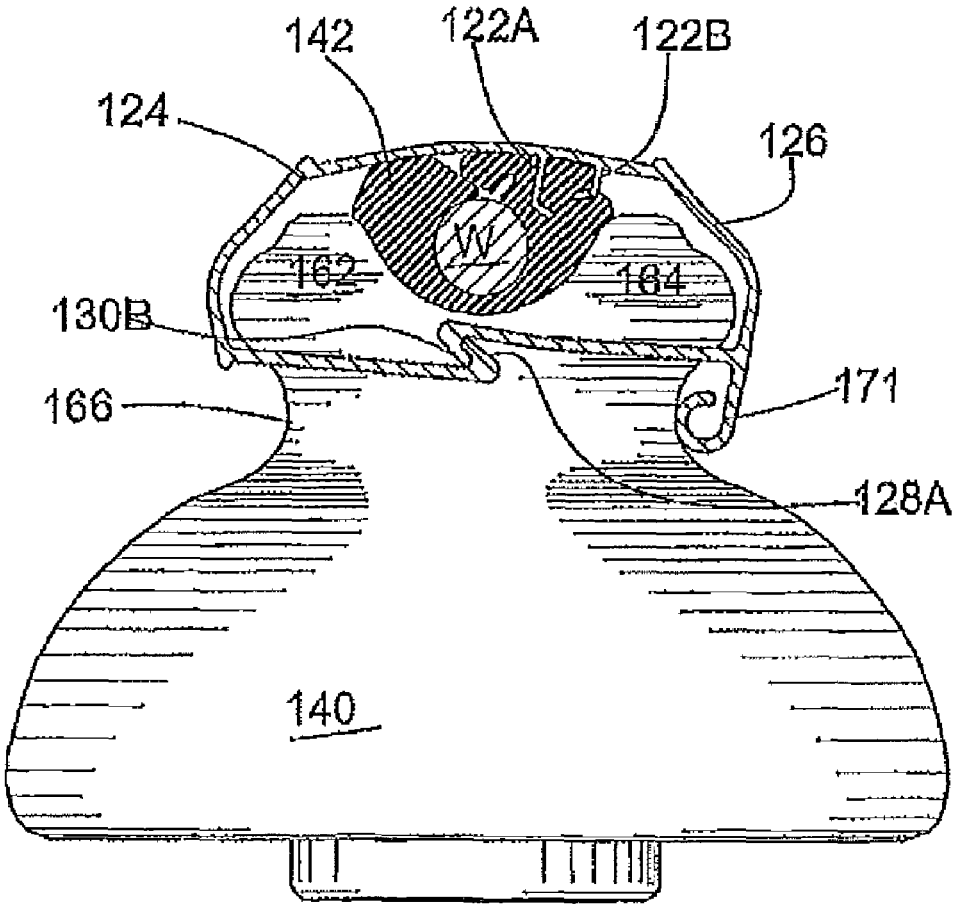

In particular, clasp 120 would be useful if the electrical utility company wishes to introduce a system under which the cross-beams C at the top of the tower T are first detached and lowered therefrom to ground level, and then the following steps are followed:

- an electrical cable fitter worker on the ground, manually grabs the clasp 120 and slides the electrical cable W into the clasp passageway along arrow A1, as suggested in FIG. 14;
- the worker manually spreads apart the rubber sheath 142 to open up the sheath mouth 145, and then this electrician worker then manually inserts the cable W through mouth 145 and into the rubber sheath 142, as suggested by arrow R2 in FIG. 15;
- the electrician releases its manual pulling action on the rubber sheath 142, wherein the mouth 145 thereof closes, thus trapping the cable W inside the rubber sheath 142, as shown in FIG. 16;
- then, as suggested by FIGS. 17, 18 and 19, the electrician—who is still on the ground—manually installs the clasp 120 and associated cable W on a ground located insulator 40; at this stage, the clasp 120 stands on the insulator 10, and remains attached thereto in three ways: laterally by the retaining arms 124, 126, which engage each side of the insulator jutting parts 162, 164; by the elbowed web part 122 at the concave end of the clasp 120 which keeps the clasp 120 against the top sections 162A, 164A of the insulator jutting parts; and by the rubber sheath 142 which abuts against the insulator saddle 160A. The electrical line fitter will slightly close the clasp 120, manually or with a simple hand tool, so as to sufficiently deform the convex web 122 to ensure that the clasp 120 is maintained onto the insulator.
- the cross-beam C is returned to its original position at the top of the tower T;
- the electrician, then moves at the top of the tower T and uses the biasing tool (that will now be detailed per reference to FIGS. 20 to 26) to complete the installation of the clasp 120 by drawing both clasp arms 124, 126 toward one another so that their flanges 128, 128', 130, 130' overlap and interlock with one another.

Thus, it is only at that last step that the biasing tool of FIGS. 20 to 26 is used. The tightening of the electrical cable to the insulator is completed after the suspended cable length between this tower T and the next successive one has been properly adjusted to meet regulations.

It is noted that the alternate embodiment of elbowed clasp 120 illustrated in FIGS. 14 to 19 of the drawings, could also be very useful at inflexion points along the electrical cable distribution network. Indeed, the upright towers supporting the high voltage electrical cables tend to be successively aligned with one another along most of their travel, except that once and a while, some curves need to be brought to the cable travel to accommodate upcoming obstacles, wherein the electrical cables become "angled" at a given tower. With the present clasp 120, the cables W above an angularly deflecting tower T will still be able to effectively remain into the saddle main central trough 60, even considering the induced transverse loads. On the contrary, with conventional prior art connectors over angularly deflecting towers T, the location of the cable W onto the insulator needed to be shifted to fit into the saddle lateral trough 66, in order to compensate for the angular loads sustained, otherwise the cable W could accidentally release from its insulator for example under high winds.

FIGS. 20 to 26 show a preferred embodiment of biasing means 340 forming a biasing tool 200, adapted to engage the insulator 40 and cable W when both insulator and cable are at a high level relative to ground, once the clasp 20 has been previously mounted to the tool 200 e.g. at ground level. Tool 200 is adapted to engage and deform the clasp web 20 so that flanges 28, 28', 30, 30', of arms 24, 26 can be forcibly brought together against the inherent spring bias of the resilient clasp, sufficiently to enable flanges 28, 28', to reach out and overlappingly interlock with flanges 30, 30'. Tool 200 includes a main frame 202, a lower fork 204, a pair of intermediate and upper engagement arms 205, 206 respectively, for the electrical cable W, and a compression panel 208 for acting against the external top wall of clasp 20.

Compression panel 208 generally forms a pocket, arcuate in cross-section as illustrated. The opposite lateral ends of panel 208 each include an enlarged inturned stopper 207A, 207B, and the intermediate section of panel 208 includes two laterally spaced transversely extending pressure fingers 209A, 209B, located inside the open pocket of arcuate panel 208. Panel 208 is sized to snugly accommodate the clasp 20 in the pocket thereof, with arms 24, 26, frictionally retainingly engaged by stoppers 207A, 207B respectively, and with pressure fingers 209A, 209B, transversely abutting against the outer wall of clasp web 22 opposite clasp web ears 22A, 22B.

A main lever arm 210 is pivotally mounted at an intermediate pivot mount 212 to a central outer wall section of compression panel 208, at an outer pivot mount end thereof 214 to the outer end of the upper engagement arm 206, and an an inner pivot mount end thereof 216 to the outer end of a piston rod 217 from a hydraulic ram 218. The cylinder 220 of ram 218 is pivotally mounted at 222 to the main frame 202. Hydraulic cylinder 220 is of the spring biased simple action type, including a spring 220A adjacent the pivot mount 222. An elongated ground operated pole 224 may be pivotally connected at a quick disconnect pivotal yoke mount 226 to the main frame 202, for remote operation of tool 200. Hydraulic fluid for the ram cylinder 220 is fed through a hydraulic line 228 extending along the pole 224, to control panel at the bottom of pole 224.

Lower transverse fork 204 is integrally connected to intermediate arm 205 and upper arm 206, by a transverse connector arm 230. Connector arm 230 is slidably engaged against an inclined ramp 232 forming a face of main frame 202 that is opposite pivot mount 226 and upwardly outwardly inclined relative thereto. Accordingly, fork 204 and arms 205, 206, are all movable as one relative to main frame 202 and relative to pivot mount 226 at the top end of elongated ground operated pole 224. However, because of the interplay of pivot mounts 212, 214, 216 and 222, and of the inclination of sliding ramp 232 for sliding motion of connector 230 against main frame 202, some relative tilting motion of fork 204 and arms 205 and 206 will occur upon piston 217 extending or retracting from hydraulic ram cylinder 218.

Figure 20:
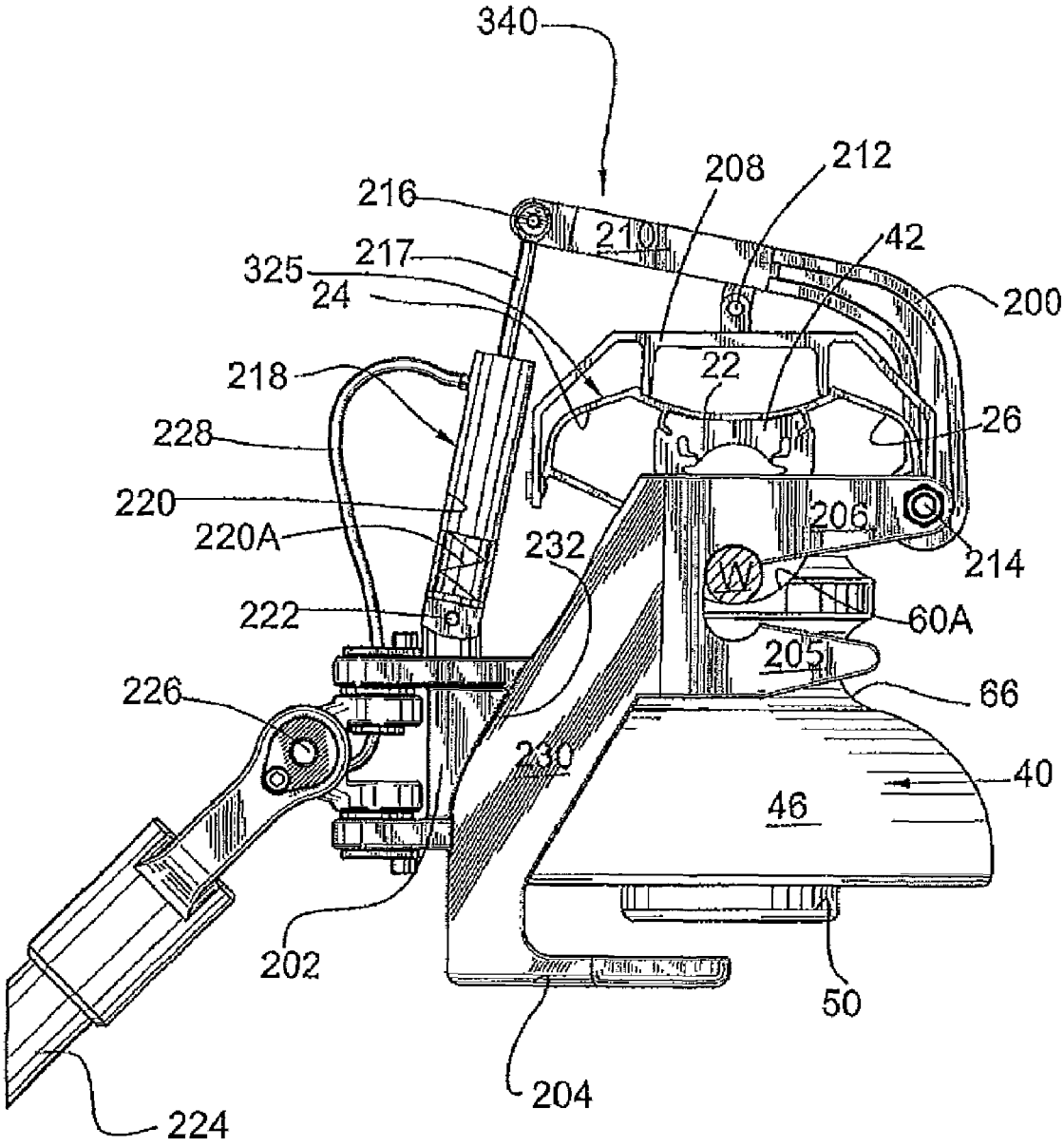
FIG. 20 is a side elevational view of a preferred embodiment of pneumatic tool and clasp, cable and insulator according to the invention, for progressively applying the closure biasing force against the external wall of the clasp of FIG. 2.
Figure 21:
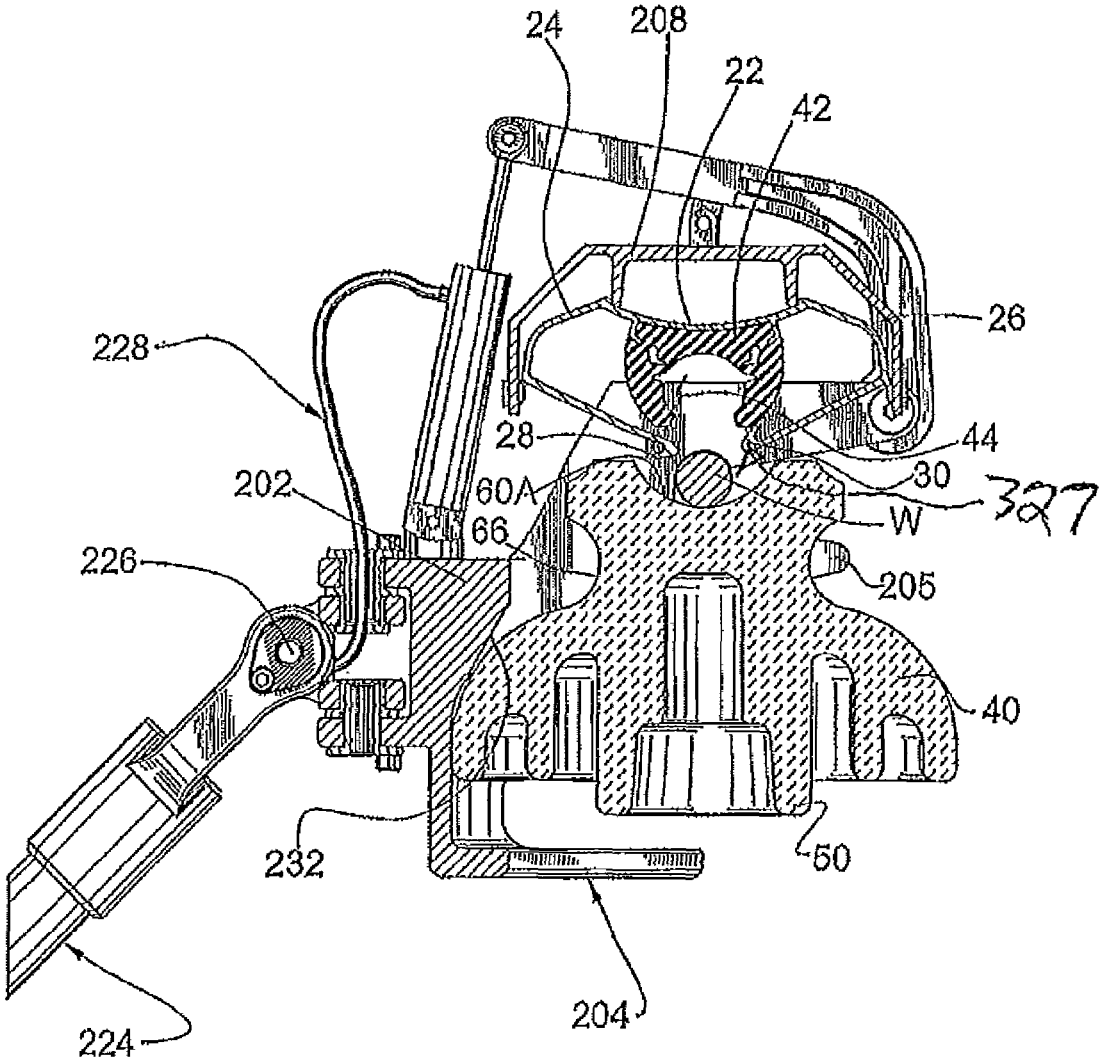
FIGS. 21-26 are views similar to FIG. 20 but with the insulator in cross-section, and sequentially suggesting first how the cable on the insulator saddle is progressively brought into the clasp inner elastomeric sheath (FIGS. 21-24) and then how the clasp arm lips become progressively interlocked.
Figure 22:
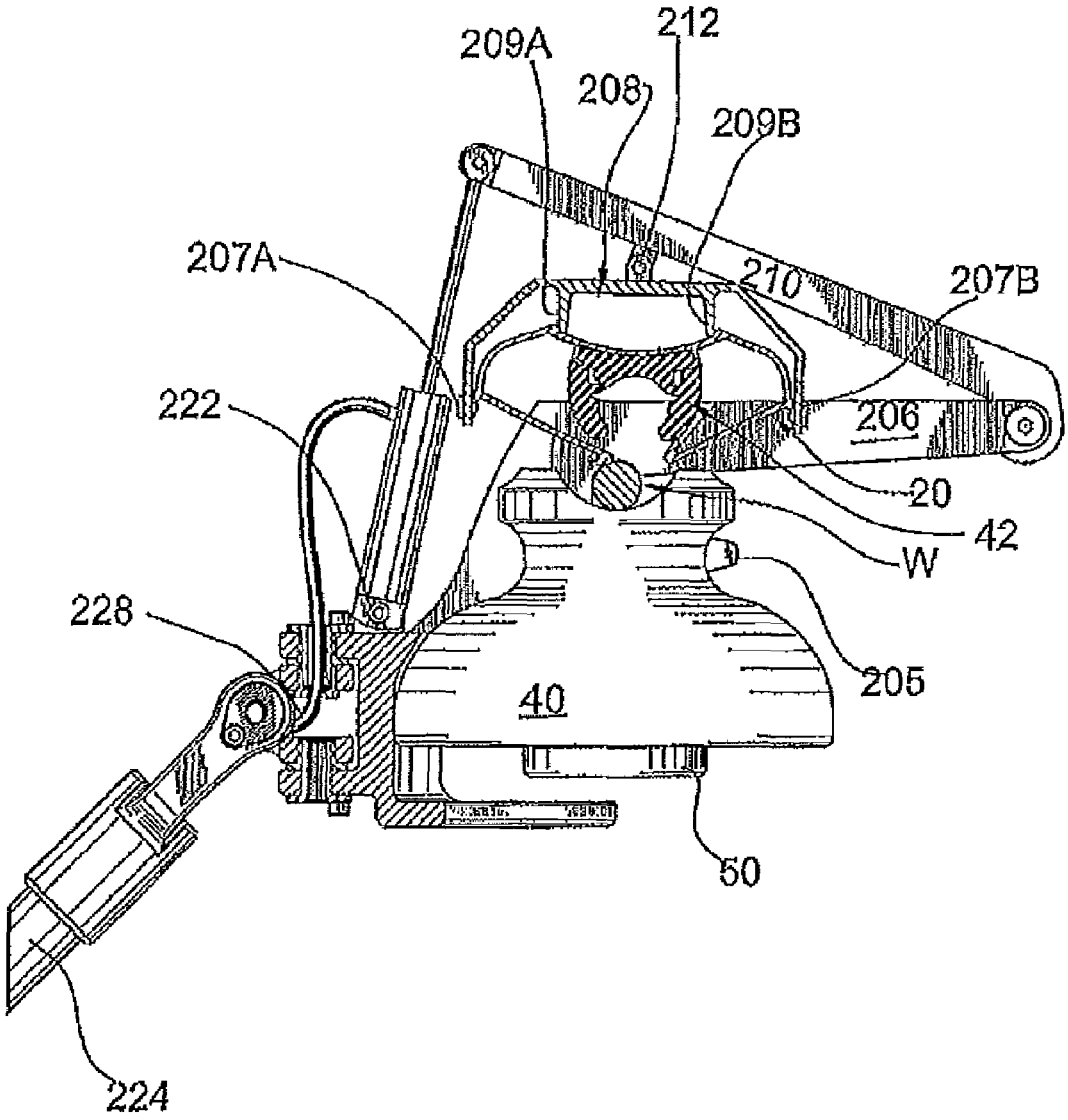

In use, and as illustrated in FIGS. 20-22, the operator must first engage the clasp 20 into the pocket of the compression panel 208, frictionally interlocking same with stoppers 207A and 207B. In this fashion, the clasping tool 200 can be handled without accidental motion of the clasp. The operator then engages the clasping tool 200 directly against the side wall 46 of the insulator 40, with the slider connector arm 230 engaging insulating wall 46, and lower fork 204 extending spacedly beneath insulator flooring 50, while engaging the electrical cable W in between the intermediate and upper arms 205 and 206.

Figure 23:
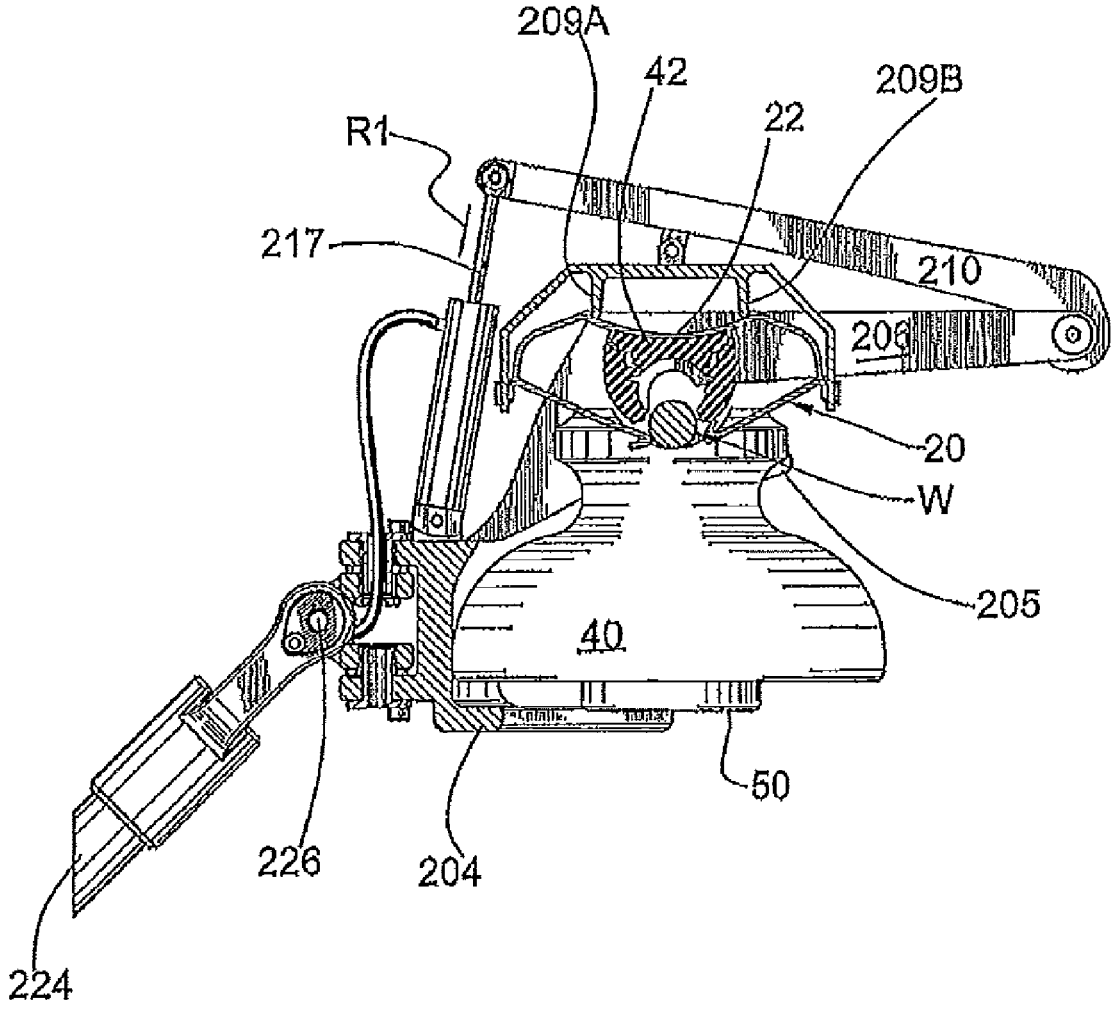

FIG. 23 shows the next step, where the cable engagement arms 205, 206 keep the electrical cable W loosely hanging onto insulator saddle 60 on each side of the insulator 40 and staying in a lower cavity, between the engagement arms 205, 206. The ground operator then drives the hydraulic ram 218 to retract piston 217 along arrow R1, so that the lever arm 210 pivotally applies compressive force against the rubber sheath 42, through the fingers 209A, 209B of compression panel 208. Since the rubber sheath 42 will for a short while resist this biasing force, fork 204 and arms 205 and 206 will move upwardly and consequently fork member 204 will move closer to the bottom annular rim 46A of insulator skirt 46.

Figure 24:
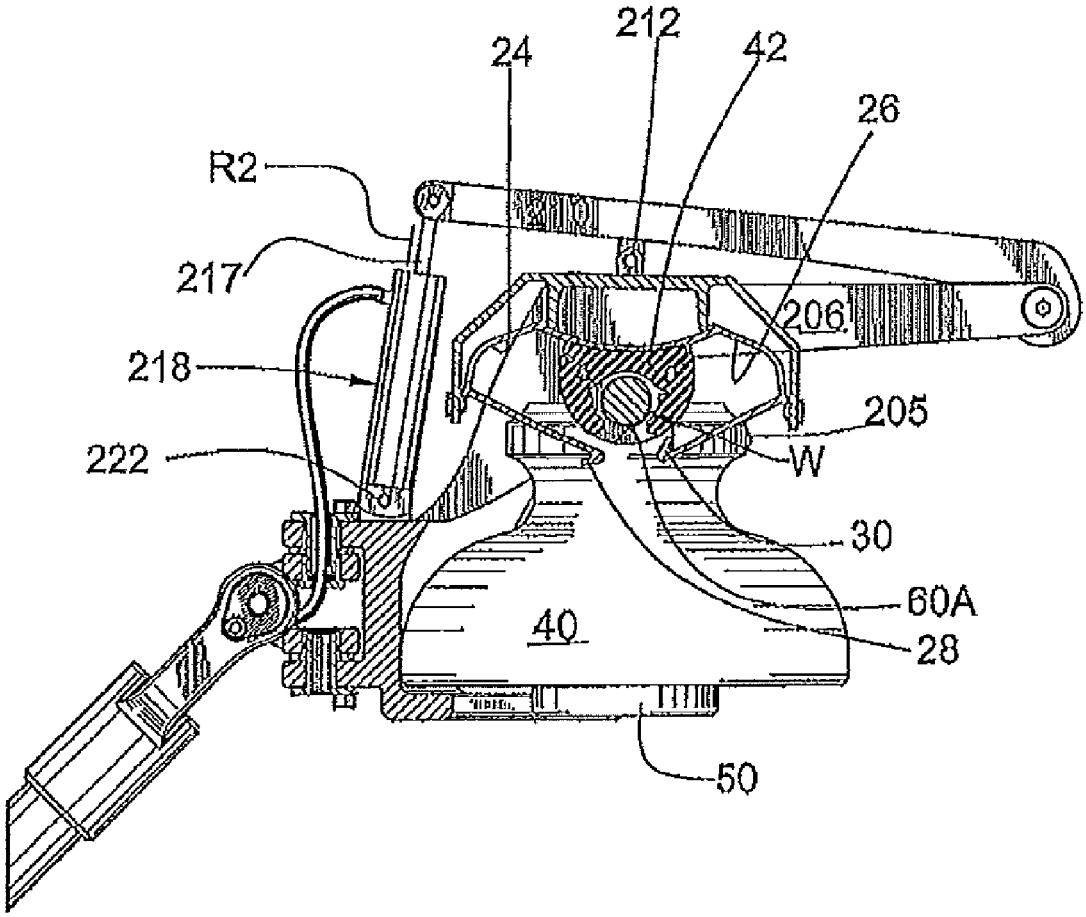

In the next step illustrated in FIG. 24 of the drawings, further retraction of piston 217 along arrow R2 brings the lower fork 204 to move upwardly. The electrical cable W is also brought upwardly by corresponding motion of intermediate engagement arm 205. Cable W extends progressively through the sheath mouth 45 and into sheath enclosure 44, and engages the body of rubber sheath 42. The cable W then becomes completely engaged into the rubber sheath enclosure 44. Once the lower fork 204 reaches the bottom edge 46A of insulator 40 and engages therewith, rubber sheath 42 is further compressed and bending compressive forces start being applied against the body of the clasp 20. However, continuing compressive pressure by the main lever arm 210 under continuing piston retraction from ram 218 progressively deforms the rubber sheath 42 which will slide beneath the cable W and will seal its mouth 44 against the insulator saddle 60.

Figure 25:
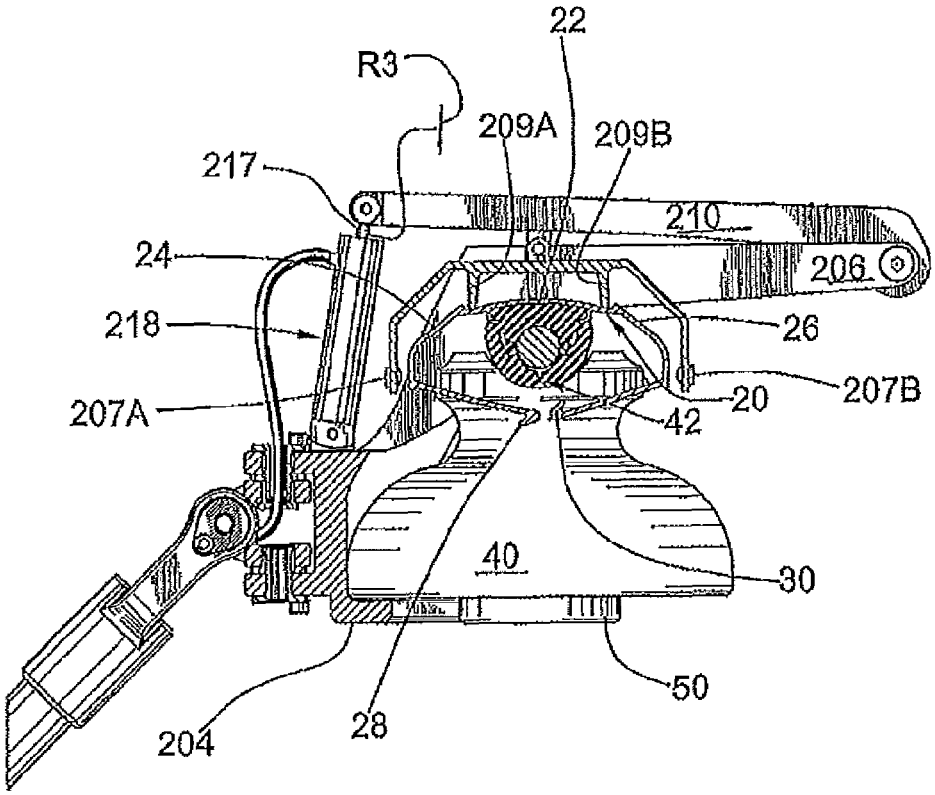

In the next step illustrated in FIG. 25, piston 217 progressively becomes more retracted under hydraulic forces from ram 218, along arrow R3 under the compressive forces, the clasp 20 progressively deforms and the rubber sheath 42 completely engages with the clasp. Flanges 28, 28', 30, 30', move closely toward one another, but still remain spaced apart by a reduced gap. In view of the two bearing points of the compression panel 208, deformation of the clasp 20 continues so that the clasp becomes convex. Arms 24, 26, release stoppers 207A, 207B, as arms 24, 26, move inwardly toward one another under the progressively increasing compressive bias applied against clasp web 22 by compressive panel transverse fingers 209A, 209B.

Figure 26:
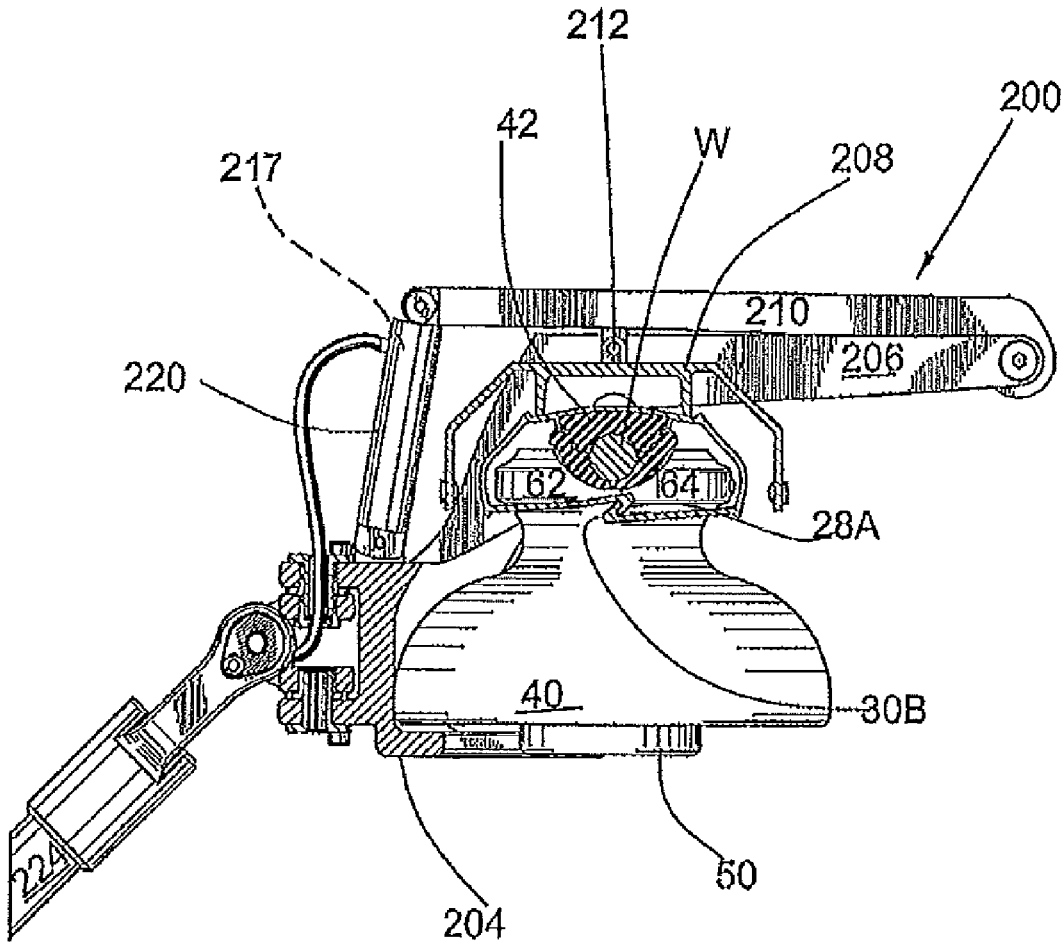

In the final step shown in FIG. 26, piston 217 has reached its fully retracted condition in ram cylinder 220, and the main lever arm 210 maintains its compressive action that deforms the clasp 20, to a point where the flanges 28, 28', 30, 30', come in transverse register with one another and overlap in interlocking fashion. At that time, there is a "click" sound cue that confirms that interlock has occurred between clasp arms 24 and 26, whereby clasp web 22 and arms 24 and 26 form a closed loop member trapping therein the insulator saddle jutting parts 62, 64, and the cable W surrounded by rubber sheath 42.

Thereafter, compressive pressure can be released by compressive panel 208, by fully extending piston 217 from its cylinder 220, thus detaching compressive panel 208 from closed clasp 20. Clasp 20 retains its closed shape, even without bias from too 200, because flange lips 28A, 30A of side arm flanges 28, 28', 30, 30', remain interlocked in overlapping fashion, as shown. The ground operation may therefore remove the clasping tool 200 by pulling pole 224 away from insulator/cable/clasp assembly 40, W, 20. Pole 224 may be brought to a new insulator location, for a new cable installation cycle of operation.

The invention claimed is:

1. A self-locking system for locking a section of suspended electrical conductor cable to a pin type insulator, the insulator having an upper arcuate saddle part, defining a groove for receiving therein the cable, and two opposite jutting parts, a main peripheral skirt body having an intermediate annular recess, and a lower end for engagement by an upright pin, said self-locking system comprising;

an arcuate clasp defining a resilient web, first and second side arms integrally projecting from opposite ends of said web, each of said first and second side arms defining corresponding first free end flange and second free end flange opposite said web, said first free end flange being in spaced register with said second free end flange and defining therebetween a gap in the unbiased condition of said resilient web whereby a generally open pocket is circumscribed by said web and said side arms and for receiving therein the electrical conductor cable; said gap sized to accommodate free transverse passage of the electrical conductor cable; each of said side arms defining a recess sized for transverse through passage by a corresponding one of the jutting parts of the insulator saddle;

wherein said first free end flange and said second free end flange form when assembled a complementary interlocking joint assembly; and biasing means, for biasing said clasp against the resiliency of said web to close said gap and to concurrently engage said first free end flange and said second free end flange into said interlocking joint assembly, said side arms sized to retainingly fit into the intermediate annular recess of the insulator beneath the jutting parts thereof when said first free end flange and said second free end flange become interlocked.

2. A self locking system as in claim 1, further including an elastomeric sheath member, integrally carried by said web within said pocket of said clasp, said sheath member being arcuate in unbiased condition defining an enclosure with an access mouth sized for enabling access by the conductor cable to said sheath member enclosure.

3. A self-locking system as in claim 2, wherein said first and second side arms of said clasp are also made from a resilient material.

4. A self-locking system as in claim 3, wherein said sheath member enclosure access mouth is offset relative to said gap of said clasp.

5. A self-locking system as in claim 4, wherein in the unbiased condition of said clasp, said web is elbowed and said first side arm is symmetrically offset from said second side arm relative to said web, so that an enlarged cable passageway is defined between said first side arm and said sheath member.

6. A self-locking system as in claim 2, wherein said sheath member enclosure access mouth comes in register with said gap of said clasp.

7. A self-locking system as in claim 3, wherein said first free end flange defines a first lip means and a first trough means; and wherein said second free end flange defines a second lip means and a second trough means, said first lip means engaging said second trough means when said first free end flange and second free end flange reach their interlocked assembled state.

8. A self-locking system as in claim 3, wherein said biasing means includes a rigid arcuate compression member, complementary in shape with said clasp so as to define a generally open cavity for accommodating therein said clasp, said compression member having opposite clasp retaining ears for frictionally releasably engaging said side arms of said clasp inside said open cavity, and compressive fingers projecting transversely from an intermediate section of said compression member, for engaging said resilient web on the outside face of said web relative to said compression member cavity; hydraulic ram means, for releasably biasing said compression member to deform said clasp side arms whereby said web side arms progressively move toward one another to close said gap; and a pivotal lever arm assembly, cooperating with said hydraulic ram means for supporting the insulator and conductor cable relative to said clasp.

9. A self-locking system as in claim 8, further including an elongated pole member, and means for mounting said pole member to said pivotal lever arm assembly for relative controlled movement thereabout, wherein said self-locking system is remote-controlled.

10. A self-locking system as in claim 9, wherein said pivotal lever arm assembly includes:

a main rigid frame;

an elongated arcuate first lever arm;

a first pivot mount, pivotally interconnecting an intermediate section of said compression member to said first lever arm;

said hydraulic ram means including a cylinder and a piston, said piston having an outer free end, and hydraulic fluid feed means coupled to said cylinder;

a second pivot mount, pivotally interconnecting said cylinder to said main rigid frame;

a third pivot mount, pivotally interconnecting said piston outer free end to an inner end of said first lever arm;

first and second insertion legs, for engagement therebetween of the conductor cable, and a diverging bracket interconnecting said first and second insertion legs, said first leg having an outer end;

a fourth pivot mount, pivotally interconnecting an outer end of said arcuate first lever arm opposite said inner end thereof to said first insertion leg outer end; and an inclined ramp made on said main rigid frame, said ramp slidingly engaged by said insertion legs bracket;

wherein said insertion leg bracket progressively upwardly sliding along said ramp upon said piston being retracted from said cylinder, while said compression member concurrently biases said side arms of said clasp to close said gap.

11. A self-locking system for locking a section of suspended electrical conductor cable to a pin type insulator, the insulator having an upper arcuate saddle part defining a groove for receiving therein the cable and two opposite jutting parts, a main peripheral skirt body having an intermediate annular recess, and a lower end for engagement by an upright pin, said locking system comprising:

resilient clamping means having an inner pocket, for receiving therein the electrical conductor cable, retaining means for retainingly engaging the insulator jutting parts, and an access port for transverse passage of the cable into said pocket, said access port being opened in an unbiased condition of said resilient clamping means;

a quick coupling joint means including a first flange frictionally engaged with a second flange, said quick coupling joint means cooperating with said clamping means for releasably maintaining in closed condition said access port against the resiliency of said clamping means; and biasing means, for biasing said clamping means against the resiliency of said clamping means to close said gap and to enable concurrent engagement of said quick coupling joint means.

12. A self-locking system as in claim 11, further including an elastomeric sheath member, integrally carried by said clamping means within said clamping means pocket, said sheath member being arcuate in unbiased condition defining an enclosure with an access mouth sized for enabling access by the conductor cable into said sheath member enclosure.

13. A self-locking system as in claim 12, wherein said sheath member enclosure access mouth comes in register with said clamping means access port.

14. A self-locking system as in claim 12, wherein said sheath member enclosure access mouth is offset relative to said clamping means access port.

15. A method of installation of an electrical conductor cable onto a pin-type insulator, the insulator having an upper arcuate saddle part, defining a groove for receiving therein the cable, and two opposite jutting parts, a main peripheral skirt body having an intermediate annular recess, and a lower end for engagement by an upright pin, said method of installation comprising the following steps:

a) providing an arcuate clasp, said clasp defining a resilient web, first and second side arms integrally projecting from opposite ends of said web, each of said first and second side arms defining corresponding first free end flange and second free end flange opposite said web, said first free end flange being in spaced register with said second free end flange and defining therebetween a gap in the unbiased condition of said resilient web whereby a generally open pocket is circumscribed by said web and said side arms and for receiving therein the electrical conductor cable; said gap sized to accommodate free transverse passage of the electrical conductor cable, each of said side arms defining a recess sized for through passage by a corresponding one of the jutting parts of the insulator saddle; wherein said first free end flange and said second free end flange form when assembled a complementary interlocking joint assembly; an elastomeric sheath member integrally carried by said web within said clasp pocket, said sheath member being arcuate in unbiased condition defining an enclosure with an access mouth sized for enabling access by the conductor cable into said sheath member enclosure;

b) engaging the conductor cable through said clasp gap and into said clasp pocket;

c) engaging the conductor cable further through said sheath access mouth and into said sheath member enclosure; and d) applying a first biasing force onto said clasp against the resiliency of said web whereby said sheath member access mouth becomes closed; and e) applying a further biasing force onto said clasp against the resiliency of said web whereby said clasp gap becomes closed, while concurrently engaging said first free end flange and said second free end flange in said interlocking joint assembly; wherein said side arms are sized to retainingly fit into the intermediate annular recess of the insulator when said first free end flange and said second free end flange become interlocked.

16. A method of installation as in claim 15, wherein the above-noted steps a), b), c) and d) are carried out at ground level, and further including the following steps occurring between said step d) and step e):

d') mounting the interconnected assembly of insulator, said clasp and said cable into a pivotal open head of an elongated hand pole, d") tilting said hand pole to lift said insulator, said clasp and said cable assembly above ground to the top of an electrical cable tower; and d"') remotely actuating the pivotal head for further biasing force action against said clasp.

17. A method of installation as in claim 16, further including the step of a clicking sound cue happening after step e), confirming engagement of said first free end flange and said second free end flange in said interlocking joint assembly.

* * * * *